US005487449A

United States Patent [19]

Barrett et al.

[11] Patent Number: 5,487,449

[45] Date of Patent: Jan. 30, 1996

[54] MAGNETIC ELEVATOR DOOR COUPLING

[75] Inventors: David W. Barrett, East Hartland; Thomas M. McHugh, Farmington; Edward E. Ahigian, West Hartford; Jerome F. Jaminet, South Windsor; Thomas He, Unionville; Richard E. Peruggi, Glastonbury; Thomas M. Kowalcyk, Farmington; Richard E. Kulak, Bristol, all of Conn.

[73] Assignee: Otis Elevator Company, Farmington, Conn.

[21] Appl. No.: 223,898

[22] Filed: Apr. 6, 1994

[51] Int. Cl.[6] ..... B66B 13/12

[52] U.S. Cl. ..... 187/330; 49/122

[58] Field of Search ..... 187/330, 319; 49/120, 122

[56] References Cited

U.S. PATENT DOCUMENTS

| | | | |
|---|---|---|---|
| 2,899,021 | 8/1959 | O'Grady | 187/319 |
| 3,913,270 | 10/1975 | Kumagai | 187/319 |
| 5,174,417 | 12/1992 | Pilsbury | 187/330 |

*Primary Examiner*—Kenneth Noland

[57] ABSTRACT

A magnetic coupling device is disposed on an elevator car door in a position to engage a magnetic vane disposed on a hoistway door which is to be opened in unison with the car door. The magnetic coupling unit may comprise either an electromagnet or a permanent magnet and has spring loaded rollers disposed above and below it so as to control the initial force of engagement between the elevator car door and the hoistway door, for smoother door opening operation.

6 Claims, 1 Drawing Sheet

MAGNETIC ELEVATOR DOOR COUPLING

TECHNICAL FIELD

This invention relates to positively coupling the hoistway doors of an elevator to the elevator car doors so that the hoistway doors can be driven open and driven closed, in unison with and by the motion of the elevator car doors as they are driven open and driven closed by a door operating mechanism.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the landing doors in unison therewith, thereby protecting passengers in the car from the building structure and protecting passengers at the landing from the hoistway.

The manner of coupling the doors together must take into account several factors. The doors usually begin to open just before the car reaches the landing (such as 10 or 15 centimeters therefrom), resulting in relative vertical motion between the elevator door and the hoistway door as the elevator approaches the landing. A similar constraint is that the car may be releveled after the doors are open, which also requires permissible relative vertical motion between the car doors and the hoistway doors. The hoistway doors may easily be pushed open by the elevator doors, but they must also become closed, either by being pulled (or pushed) toward the closed position by the elevator doors, or by some biasing in the closed direction. Biasing in the closed direction may take the form of a spring, a weight or aspirator. However, any bias in the closed direction must be overcome by the force exerted by the elevator doors during the opening process. Therefore, such bias is usually limited to a minimal amount necessary to meet self-closure requirements in government codes. Similarly, any perturbations in the bias during the opening process will in turn provide perturbation in the control algorithm for the elevator door opening system. Therefore, it is deemed preferable to have the hoistway doors opened and closed by the elevator doors, without separate bias.

A typical coupling device employs a rigid vane mounted on the car door which engages a rotatable pawl on the hoistway door, the pawl having rollers thereon so that the vane can travel upwardly or downwardly while engaging the pawl. Typically, there may be some lost motion between the two doors; that is, the car door must begin to open before it engages the pawl, unlocking the hoistway door, and commencing to push the hoistway door, through the pawl, in the open direction. When closing, the hoistway doors must be fully closed before the car door motion stops (before the car doors are fully closed). In some assemblies, the rollers move into contact with the vane before motion, and in others, the vane is expanded to contact the rollers before any motion. However, devices of this type are wear and adjustment sensitive and require frequent adjustments and replacements over the life span of an elevator system.

Whenever there is a change in the amount of force required to move an elevator car door, either because of lost motion between it and a hoistway door, or because of a change in the mechanism leverage and the like, perturbations can result within the electrical control system which provides the motive force for the car door opening mechanism. This in turn can cause vibrations and other mechanical perturbations, thus resulting in additional wear and noise. And, in very tall buildings, door closing (particularly at the lobby) can be erratic due to hoistway air pressure (called "windage" or "chimney effect"), unless the hoistway doors are closed positively.

Of course, any coupling mechanism located on a particular hoistway door must have complete clearance, for all of the apparatus, including the corresponding parts of a coupling device which are mounted on the car door, so that elevators that are simply passing by landings do not run the risk of contact with the hoistway door coupling devices.

DISCLOSURE OF INVENTION

Objects of the invention include provision of a horizontally stiff coupling between an elevator car door and a hoistway door which, however, allows relative vertical motion between the car door and the hall door when coupled, and which is simple, easy to install, and requires little maintenance.

According to the present invention, a coupling, to cause an elevator car door to firmly engage a hoistway door which it is to move in opening and closing directions includes a magnet disposed on the elevator car door in a position to magnetically engage a magnetic vane disposed on a hoistway door, the magnet being fitted with spring loaded rollers to control the buildup of force exerted by the car door on the hoistway door as the car door begins to open and the magnet approaches the vane. The magnet may be either an electromagnet or a permanent magnet. The car door may be coupled to the hoistway door by a pair of magnet and roller coupling units, one at the top of the doors and one at the bottom of the doors, thereby to avoid creation of a rotational torque as the doors are being opened.

The present invention is relatively simple, it needs little adjustment during installation, and it does not require adjustment due to wear. The present invention provides a smooth transition from the doors being totally uncoupled to the doors being fully engaged with stiff horizontal coupling. In an embodiment employing a permanent magnet, the invention has the advantage of eliminating the need for electric wires traveling with the car doors.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
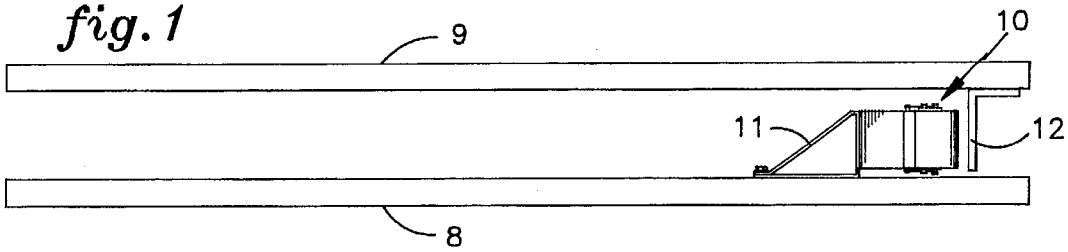
FIG. 1 is a simplified, top plan view of a coupling of the present invention in its environment.
Figure 2:
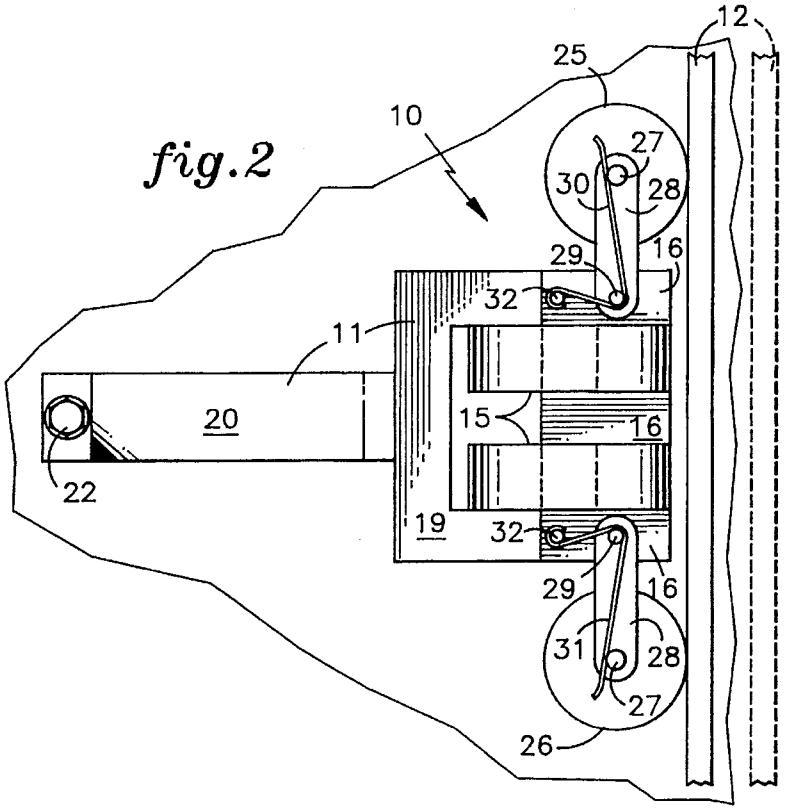
FIG. 2 is a partial, side elevation view of a magnetic elevator door coupling in accordance with the present invention.

Referring now to FIG. 1, an elevator car door 8 engages an elevator hoistway door 9 by means of a magnetic coupler 10 secured to the car door 8 by a bracket 11, the coupling engaging a vane 12 disposed on the hoistway door 9. In FIG. 2, the magnetic coupler 10 may comprise a magnet together with flux-steering pole pieces. The magnet may comprise an electromagnet, or a permanent magnet. As seen in FIG. 2, an electromagnet having two electric coils 15 wound on an E-shaped core 16 comprise the magnet and flux steering pole pieces. However, the coils 15 may be supplanted with permanent magnets, and the pole pieces may be arranged as other than the E-shaped core 16 shown.

The mounting bracket 11 may include a frame 19, which may be brass or ,other non-magnetic material, secured to the core 16 in any suitable fashion such as by machine screws. The mounting bracket 11 may further include a strap 20 secured thereto, such as by bolts 21 (FIG. 3), which in turn may be secured to the car door 8 by means of a bolt 22. The strap 20 is seen in FIG. 2 to be narrower than the frame 19; however, for a more rigid assembly, the strap 20 may be made much wider, and use of more bolts may be desirable. None of this is significant to the present invention.

Figure 3:
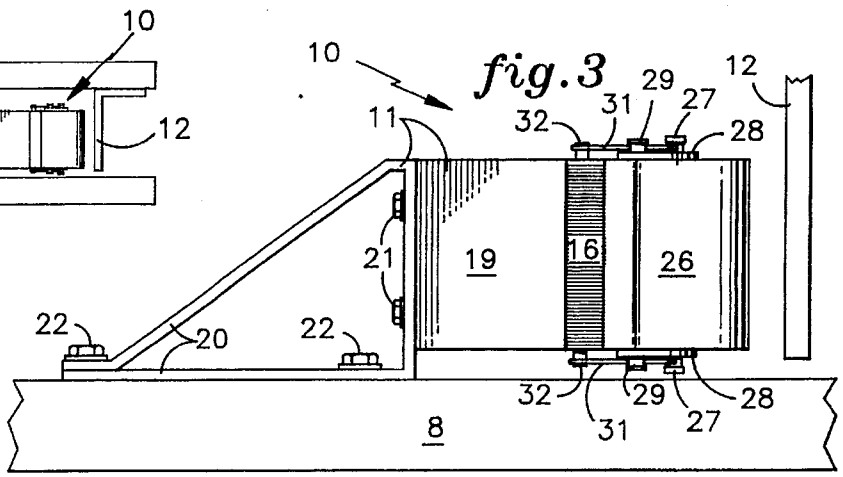
FIG. 3 is a partial top plan view of the coupling of FIG. 2.

A pair of rollers 25, 26 each rotate on axles 27 supported by pivoting arms 28 which are rotatably joined to the E-core by means of pins 29. Each of the axles 27 is urged to the right (as seen in FIGS. 2 and 3) by a corresponding pair of leaf springs 30, 31. The leaf springs 30, 31 are anchored to the E core 16 by means of pins 32. In an initial clearance position, as is illustrated in FIG. 3, the leaf springs 31, 32 may be fully relaxed. As soon as the rollers 25, 26 contact the vane 12, due to the car door 8 moving in the opening direction (to the right as seen in FIGS. 1–3), the springs 30, 31 begin to deflect and, being stiff springs, apply force to the vane 12 to begin opening the hoistway door 9 (to the right as seen in FIGS. 1–3). Thus, the rollers 25, 26 are initially extended somewhat to the right as seen in FIG. 3 with the vane being in the position shown solid in FIG. 3 and shown in dotted lines in FIG. 2. In this initial, clearance position, there may be on the order of 2 centimeters of clearance between the rollers 25, 26 and the vane 12. After contact and a flexure of the springs 30, 31 eventually the E core 16 will come into tight contact with the vane 12, causing significant magnetic attractive force (due to the lack of any significant gap therebetween) thereby rigidly coupling the two doors together for horizontal movement.

The invention may be practiced in a variety of ways. In an embodiment of the invention employing electromagnets 15, the current to the electromagnets 15 may be totally turned off during advance door opening, to render it easier for the coupling unit 10 to slide upwardly or downwardly along the vane 12 as the car decelerates to a complete stop at the landing. Similarly, the current to the electromagnets 15 may be turned off during releveling, after the doors are open, to permit vertical sliding of the magnetic coupler 10 against the vane 12. Or, in either of these conditions, the current to the electromagnets 15 might simply be reduced.

On the other hand, when a permanent magnet is employed, there is no way to reduce the magnetic attractive force between the magnetic coupler 10 and the vane 12. Therefore, smooth, slippery surfaces may be employed to enhance the ability to slide vertically during advance door opening and releveling. In fact, coatings of lubricative plastics, such as delrin and teflon, may be employed on the magnetic coupler 10 and/or the vane 12. In such a case, a heavier magnet or larger coils may be required in order to provide adequate magnetic attractive force (both to prevent erratic coupling in the door-opening direction and to assure complete and tight coupling in the door-closing direction).

Figure 4:
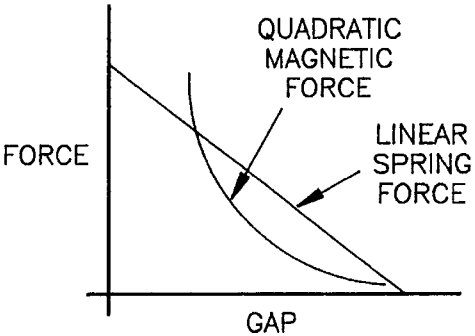
FIG. 4 is a plot of spring and magnetic forces as a function of gap.

The attractive force between the magnetic coupler 10 and the vane 12 is plotted in FIG. 4. As is known, the magnetic force is greatest when the gap is very small and becomes maximum when the gap is zero. On the other hand, because of the arrangement illustrated best in FIG. 2, the linear spring force is minimum when there is a maximum clearance gap (as in FIG. 1) and at the exact point where the rollers 25, 26 contact the vane 12. As the car door 8 opens, the inertia of the hoistway door causes counter force which deflects the springs 30, 31, increasingly, until maximum spring deflection is reached at the point where the magnetic coupler 10 (e.g., the E-core 16) is in contact with the vane 12 (FIG. 4). If the electromagnet were turned on, for instance, when the springs were only partially deflected, the attractive magnetic force, to the left as seen in FIGS. 2 and 3, would cause a leftward acceleration of the hoistway door 9 (which may be thought of as deceleration), causing a mechanical perturbation which is reflected back into the electrical control system driving the magnet and which causes mechanical vibration and noise.

On the other hand, if the magnetic force is initially established in a balanced manner with respect to the spring force, no leftward acceleration (or deceleration) would occur. The balance has to be such that any tendency to increase the deflection of the springs, and thereby increase the resulting acceleration (which is proportional to force), may be partially or completely met by a corresponding magnetic attractive force, which would cancel only some or all of the increase in spring force, leaving the net force either constant or monotonically changing (increasing when opening, decreasing when closing), and therefore maintaining the acceleration constant or monotonically changing. The manner of balancing the forces is relatively straightforward, and may be established relatively quickly, empirically, for any particular design in which the present invention is implemented.

The foregoing is also true with respect to a permanent magnet. At any given spacing, the permanent magnet will apply force as illustrated generally in FIG. 4. When the gap is reduced to zero, this force is much greater (on the order of 100 pounds) than the maximum spring force (which may be on the order of 15 or 20 pounds). In any event, by adjusting the neutral position of the springs (that is the spacing between the edge of the rollers and the right face of the magnet coupler 10), the spring constant of the springs, and the magnitude of the magnetic field, these forces can be suitably balanced so as not to provide perturbing decelerations to the hoistway door as the magnetic coupler 10 becomes fully engaged with the vane 12. In order to disengage the hoistway door from the car door at the end of a door cycle, the car door operating mechanism must have the strength to overcome the attraction of the permanent magnet to the vane 12. Having the faces both coated with lubricating plastic will provide a small gap to reduce the force necessary to disengage them.

Figure 5:
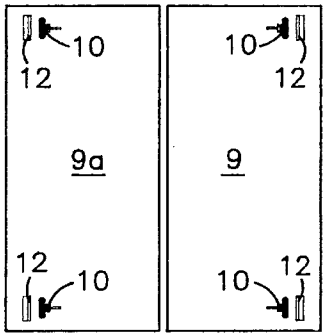
FIG. 5 is a simplified, partial side elevation view of a pair of hoistway doors employing four coupling units of the present invention.

As illustrated in FIG. 5, vanes 12 may be located at both the top and the bottom of the hoistway door 9 and a companion hoistway door 9*a*, for operation with respect to corresponding magnetic couplers 10. This will reduce any tendency to create rotational torque in the door opening and closing operations, for smoother and quieter door operation.

One roller could be used, instead of two, if desired.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for coupling an elevator hoistway door at a landing to an elevator car door so that the two may be operated in unison, comprising:

a vertical, magnetically permeable vane extending outwardly into the hoistway from a surface of a hoistway door;

a magnetic coupler disposed on an elevator car door in a position so that it is adjacent said vane whenever the elevator on which said car door is mounted is within the landing zone for the landing corresponding to said hoistway door and so that opening of the elevator car door will cause said magnetic coupler to engage said vane, the magnetic force between said magnetic coupler and said vane rigidly coupling said doors together for operation in unison;

an axle attached to said magnetic coupler and disposed in a position adjacent to and vertically displaced from said magnetic coupler;

a roller disposed on said axle; and a spring disposed between said magnetic coupler and said axle resiliently urging said roller in a generally horizontal direction toward the door-open position of said car door.

2. Apparatus according to claim 1 wherein said magnetic coupler comprises an electromagnet.

3. Apparatus according to claim 1 wherein said magnetic coupler comprises a permanent magnet.

4. Apparatus according to claim 1 wherein said axle is disposed above said magnetic coupler.

5. Apparatus according to claim 4 additionally comprising:

a second axle attached to said magnetic coupler and disposed in a position adjacent to and displaced below said magnetic coupler;

a second roller disposed on said second axle; and a second spring disposed between said magnetic coupler and said second axle resiliently urging said second roller in a generally horizontal direction toward the door-open position of said car door.

6. Apparatus according to claim 5 wherein the constants of said springs and the electromagnetic force of said magnetic coupling are chosen so as to ensure a monotonic total force exerted by said car door on said hoistway door as said rollers and said magnetic coupler unit successively engage said vane as said car door is opened.

* * * * *